US006270251B1

(12) United States Patent
Bron

(10) Patent No.: US 6,270,251 B1
(45) Date of Patent: Aug. 7, 2001

(54) PUSH-BUTTON MECHANISM AND TIMEPIECE FITTED WITH SUCH MECHANISMS

(75) Inventor: Alphonse Bron, Bassecourt (CH)

(73) Assignee: ETA SA Fabriques d'Ebauches, Grenchen (CH)

( * ) Notice: Subject to any disclaimer, the term of this patent is extended or adjusted under 35 U.S.C. 154(b) by 0 days.

(21) Appl. No.: 09/553,335

(22) Filed: Apr. 20, 2000

(30) Foreign Application Priority Data

Apr. 22, 1999 (CH) ..... 0746/99

(51) Int. Cl.[7] ..... G04B 29/00
(52) U.S. Cl. ..... 368/320; 368/190; 368/196
(58) Field of Search ..... 368/190–199, 368/185, 319–321

(56) References Cited

U.S. PATENT DOCUMENTS 4,496,246 * 1/1985 Ota et al. ..... 368/88
4,788,669 * 11/1988 Kamiyama ..... 368/80
5,113,382 5/1992 Bron .
5,339,297 * 8/1994 Suzuki et al. ..... 368/321

FOREIGN PATENT DOCUMENTS 642 220 4/1984 (CH) .
2590694 5/1987 (FR) .

* cited by examiner

*Primary Examiner*—Bernard Roskoski
(74) *Attorney, Agent, or Firm*—Sughrue, Mion, Zinn, Macpeak & Seas, PLLC

(57) ABSTRACT

The push-button mechanism includes a lever (11) which pivots on a plane support (2), and includes two other pins (14, 16) arranged in a triangle with respect to the stud (12), and a second member (20) including a substantially U shaped cut-out portion (21) delimiting a base (22), and first and second arms (28, 32). The base (22) supports guide means (23) which slide along a guide ramp (3) and at least one control means (24) for a function to be activated (5, 6). The first rigid arm (28) is rotatably mounted on a first pin (14) of the lever (11) and the second flexible arm (32) has at its free end (33) a notch (34) acting as support for the second pin (16) in the inactive position, said notch (34) being extended by a beak shaped tip (36) having an external edge (38) oriented towards the exterior of the U shaped cut-out portion (21) against which the second pin (16) slides compressing the flexible arm (32) and producing a clicking by passing from one position to the other.

17 Claims, 4 Drawing Sheets

PUSH-BUTTON MECHANISM AND TIMEPIECE FITTED WITH SUCH MECHANISMS

The present invention concerns a push-button mechanism which produces a clicking to give the user a tactile or auditory indication that it is working properly and which also, when it is set in place in an apparatus, allows the force, which has to be applied on the push-button to act against the reaction force of a mechanical control element or to close an electric contact, to be adjusted.

The invention is particularly suited to a timepiece, and in particular a chronograph watch or stop watch wherein the push-buttons provided with such a mechanism allow the three conventional functions of a chronograph to be controlled, namely stop/start and reset to zero.

A push-button is a very simple control means which comprises schematically a stem and/or a small hollow cylinder closed at one end, sliding in a transverse passage of the frame of an apparatus, and held in an inactive or rest position by elastic means which push the head of the stem towards the exterior, and brought into a working position by pressure exerted on the head. The elastic means are mainly formed, either by a helical spring housed in the transverse passage and being supported by the frame, or by a leaf spring or a wire shaped spring secured to the frame by at least one of its ends and abutting directly and/or indirectly the opposite end of the stem to the head.

In applications where the proper working of the apparatus is easily perceptible, such as the lighting of a room or the switching on of an acoustic source, these control means can be satisfactory in its most simple embodiment, even if there exist numerous possible variants in the selection of materials and in assembly techniques.

In other cases, it is necessary for the user exerting pressure on the push-button to feel with certainty that the selected function has indeed been activated, even if he is not in a position to check this visually. This is particularly so in a chronograph watch, whether it is mechanical or electronic, in which the command for starting and stopping timing by pressing on an appropriate push-button has to be synchronised with an event that the user has to observe, which no longer allows him to perform a visual check of the proper working of the chronograph.

In order to overcome this drawback, various devices have been proposed to produce a clicking which is perceptible to the user when he exerts pressure. In U.S. Pat. No. 4,451,719, a stem slides in a tube against the return force of a helical spring, the stem being provided with an elastic element which has to pass through a neck of the tube to produce a clicking immediately before activating a function. Such as device has the drawback of having a clicking effect which gradually becomes indistinct as the elastic element becomes worn, and only allows adjustment of the pressure to be exerted via selection of the compressibility of the spring.

In Japanese Utility Model No. 7812/79, the elastic means are formed by a metal strip one end of which is fixed to the bottom of a case and the free end of which, which is used to hold the push-button in the inactive position, is extended by a portion bent into a U shape substantially in the longitudinal direction of the push-button. The free branch, which is also elastic abuts against a stud driven into the plate and has at its end an overthickness which the stud has to pass through producing a clicking when pressure is exerted. In this construction, it will be noted that the pressure to be exerted is finally the result of two forces depending on the strip itself to the push-button, on the free portion of the U shaped extension, and the relative positioning of the fixing points of the strip and the stud, so that the inevitable manufacturing and mounting tolerances will result in variations which cannot be controlled from one apparatus to the next as far as the force which has to be exerted on the push-button head is concerned.

In the case of a push-button used as the control for a complex kinematic chain, it will be noted finally that the pressure to be exerted can be such that the clicking is no longer perceived in a satisfactory manner.

An object of the invention is to overcome the drawbacks of this prior art by providing a push-button mechanism with a clicking device, whose elastic return means in the inactive position are of the leaf spring type and in which the force exerted on the head of the push-button can easily be adjusted.

The invention therefore concerns a push-button mechanism for activating a mechanical or electric function including first and second members which are mobile in relation to each other in planes parallel to a plane support to form return means and to produce a clicking via the action of a force F exerted by means of the push-button, characterised in that the first member is formed by a lever which pivots via one of its ends on a stud attached to the support, said lever including two other pins arranged in a triangle with respect to the stud, and the second member of generally elongated shape includes a substantially U shaped cut-out portion delimiting a base connecting first and second arms, said base including guide means intended to slide along a guide ramp attached to the support and at least one control means for a function to be activated, the first arm of said second member being rigid and having its free end rotatably mounted on a first pin of the lever and the second arm being flexible while having at its free end a notch against which the second pin of the lever rests in the inactive position, said notch being extended by a beak having an external edge oriented towards the exterior of the U shaped cut-out portion, against which the second pin of the lever slides when a force is exerted on the rigid arm via the push-button by compressing the flexible arm and producing a clicking by passing from one position to the other.

In the foregoing, the configuration of the second member having an elongated shape with a U shaped cut-out portion evidently designates more generally any member in which the edges of each arm are not all parallel, solely because of problems of assembly with other components of the apparatus.

In an embodiment in which a reduced compactness in height is sought, as is the case in a timepiece, the two members forming the mechanism are cut into a plate of uniform thickness, the lever then having a substantially triangular shape and the U shaped member having one arm sufficiently wide to be rigid and one arm sufficiently narrow to be flexible. Any material can form these two members provided that it has a certain flexibility, but a metal or metal alloy, such as a spring steel, will preferably be selected in applications where significant longevity is desired, as is the case for timepieces.

The force necessary to pass from the inactive position to the active position can be provided at the stage of designing the geometry of the two members, such as the relative positions of the two pins and the stud on the lever, the length of the flexible arm of the second member or the inclination of the external edge of the tip situated at the end of the flexible arm. This latter solution, inclination of the external edge of the tip, has the advantage of enabling mechanisms requiring different pressure forces to be made from the same rough part, simply by appropriate machining of the edge of the tip.

According to another aspect of the invention, the force necessary to pass from the inactive position to the active position can be adjusted after mounting the mechanism in the apparatus. For this purpose, the mechanism includes means for adjusting the force F which has to be applied to the push-button, these means being arranged between the edges facing the cut-out portion so as to modify the flexion point of the flexible arm or its initial distance with respect to the rigid arm. According to a first embodiment, these adjusting means are formed by a pin with a cylindrical body able to occupy several position between facing notches arranged in parallel edges of the rigid arm and the flexible arm so as to modify the flexion point thereof. According to another embodiment, the pin has an oval grooved or fluted body and it is arranged between two grooved notches facing each other arranged in the edges of the flexible arm and the rigid arm to act as a cam, by creating according to its orientation an additional adjustable force. This pin can be held either simply by being wedged between the two arms of the second member, or by bonding or welding. This construction is particularly advantageous to have a same activating force for the push-button for all the apparatus originating from the same manufacturing line, despite a reaction force which can vary from one mechanism to another, because of inevitable manufacturing tolerances, in particular when this mechanism is intended to act on a complex kinematic chain. This construction is also advantageous when a same apparatus includes several push-buttons, so that the force which has to be exerted is the same for all of them, even if the mechanisms on which they act oppose, naturally, different reaction forces, which is the case in chronograph watches which generally include a start/stop push-button and a reset to zero push-button which act separately on different mechanisms.

The control means situated on the base of the second member of the U shaped mechanism can be merged with the guide means and be formed, in the simplest embodiment, by a stud driven into the base of said second member and oriented towards the support. Equally, this combined control and guide means can be formed by an extension of the base bent into a plane perpendicular to the general plane of said second member. When pressure is exerted on the rigid arm, directly or indirectly via the push-button, the stud slides along the guide ramp to close an electric contact or to move a mechanical element. The guide ramp can be formed by an oblong hole arranged in the support or in a member attached thereto to limit the travel of the stud between two extreme positions and, as will be seen in the following detailed description, to allow, for example a toothed crown to move forward by one teeth.

According to another embodiment, the mechanism includes a control and guide means as indicated above, and a second control means for example formed by an arm extending the base so as to be able to activate two functions simultaneously or successively.

Moreover, it will be observed that by acting on the geometry of the first and second member, the mechanism according to the invention gives great freedom in the positioning of the member to be activated, with respect to the push-button which can be positioned anywhere on the middle part of an apparatus for technical or aesthetic reasons.

Other features and advantages of the present invention will appear in the following description of different embodiments, given by way of non limiting illustration with reference to the annexed drawings, in which:

FIG. 5 shows the position of the mechanism of FIG. 4 when the start/stop push-button is pushed in.

Figure 1:
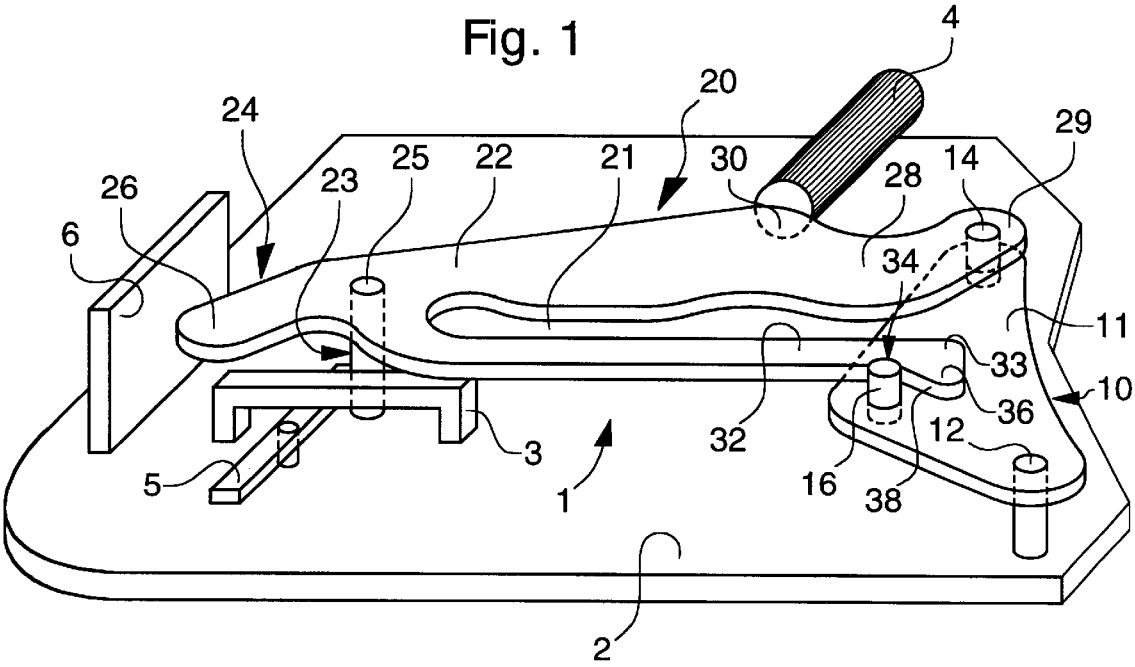
FIG. 1 is a schematic perspective diagram of a first embodiment of a mechanism according to the invention in the inactive position.

FIG. 1 shows a mechanism designated by the general reference 1, mounted on a plane support 2 which can be the bottom of any case, or a mounting member added thereto, such as the plate of a clockwork movement. The mechanism is shown in the inactive position, i.e. when no force is exerted on push-button 4. On support 2, a mechanical control member, which will be activated by mechanism 1, has been schematically represented by a lever 5, and the electric contact which will be closed is schematically represented by a contact plate 6, it being specified that it is possible to have only one function, or more than two mechanical/electric functions, according to the design of the apparatus including at least one mechanism according to the invention. Mechanism 1 essentially includes two members 10, 20 which are mobile in relation to each other, parallel to plane support 2.

A first member 10 is formed by a lever 11 pivoting on a stud 12 attached to Support 2. This lever 11 includes two other pins 14 and 16 arranged in a triangle. To facilitate understanding of FIG. 1, the useful parts of the two pins 14 and 16 attached to lever 11 are shown above the surface of said lever 11; these two pins may equally be oriented towards plane support 2, i.e. in the same direction as pivoting stud 12. This first member 10 thus has globally a triangular shape, whose precise contour will depend upon the other components of the assembly in which the mechanism will be installed.

The second member designated by the general reference 20 is elongated and includes in its median portion a U shaped cut-out portion 21, which delimits a base 22, a first rigid arm 28 and a second flexible arm 32. The free portion 29 of rigid arm 28 is rotatably mounted on a first pin 14 of lever 11. Free portion 33 of flexible arm 32 includes a notch 34 extended by a beak shaped tip 36 whose external edge 38 is oriented towards the exterior of U shaped cut-out portion 21. When the mechanism is inactive, as shown in FIG. 1, the second pin 16 attached to lever 11 is positioned so that it is held pressed against the bottom of notch 34 by a slight clamping of the two arms 28 and 32. Base 22 includes perpendicularly to the mechanism support guide means 23 shown in the form of a stud 25 driven into base 22. Equally, these guide means 23 can be formed by folding an extension of base 22. These guide means 23 are provided to slide along a guide ramp 3 attached to support 2 and schematically represented by a bar fixed by two legs to support 2. Means 24 for controlling a mechanical or electric function can be formed by an extension 26 of base 22 or by the guide means themselves, such as stud 25.

The property of rigidity or conversely flexibility of the arms can be obtained by any method known to those skilled in the art and in particular by varying the respective sections of each arm. In the most economical embodiment, second member 20 is cut into a plate of uniform thickness, for example a metal sheet, by selecting respective widths of the two arms so as to have a rigid arm 28 and a flexible arm 32.

Figure 2:
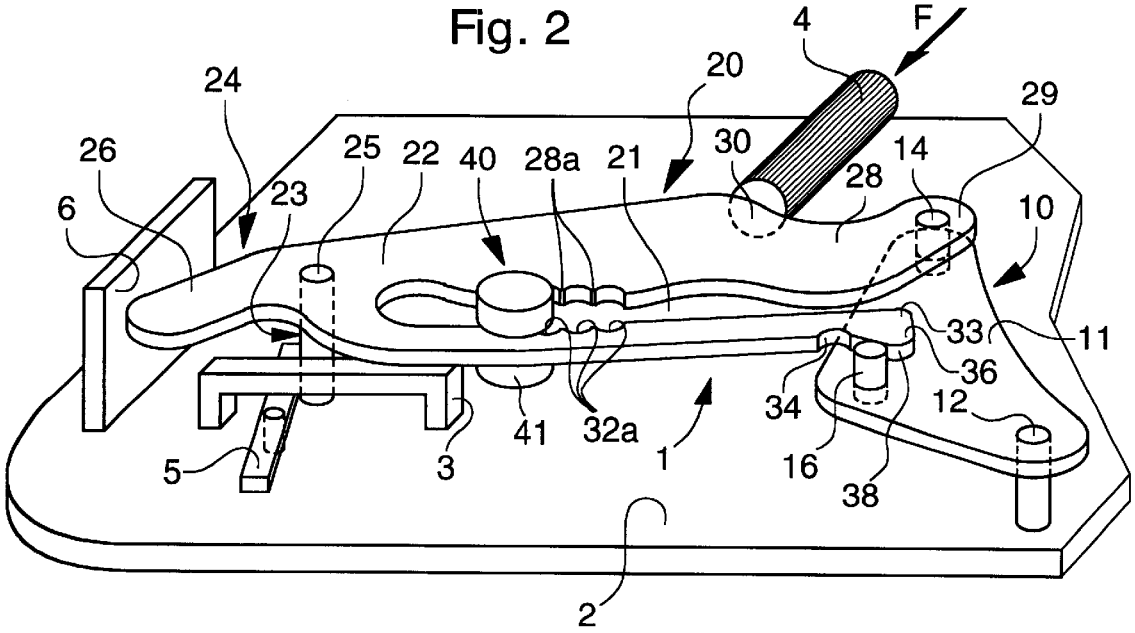
FIG. 2 is a schematic perspective diagram of a second embodiment of a mechanism according to the invention when a force is exerted on the push-button.
Figure 3A:
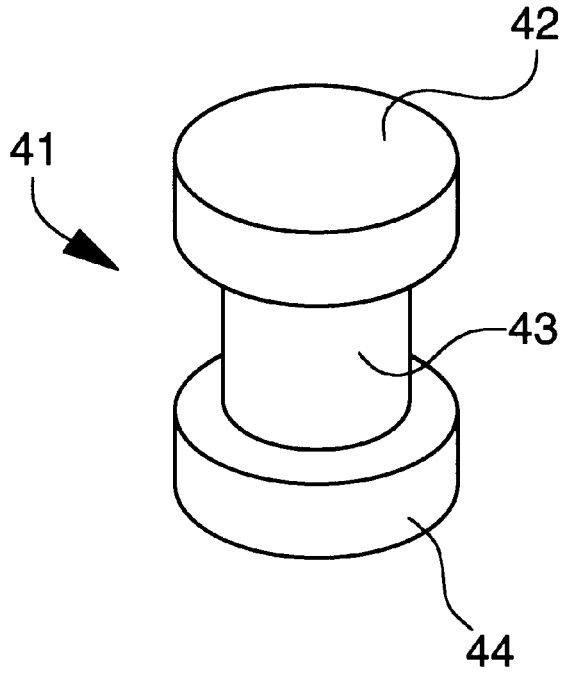
FIGS. 3A and 3B are enlarged perspective diagrams of two types of adjusting pins.

FIG. 2 shows another embodiment of the mechanism which has just been described, when a force F is applied to rigid arm 22 via push-button 4. This mechanism differs from that shown in FIG. 1 in that it includes adjusting means 40 which allow the flexion point of flexible arm 32 to be varied. These adjusting means are formed by a pin 41 with two heads 42, 44 connected by a cylindrical body 43, as shown in FIG. 3A, said pin 41 being able to occupy several positions between notches 8*a*, 32*a* arranged in the opposite edges of rigid arm 28 and flexible arm 32. By way of example, a mechanism of this type was made with four positioning notches and the reaction force was measured as a function of the position of the pin.

| | Reaction force (N) | Difference relative to the first position |
|---|---|---|
| position 1 | 6.93 | — |
| position 2 | 5.85 | 15.58% |
| position 3 | 4.99 | 27.99% |
| position 4 | 4.23 | 38.96% |
| position 5* | 3.69 | 46.75% |

*position in which the pin is removed

As is seen, it is possible to obtain a variation in reaction force of approximately 10% by passing from one position to the next.

Figure 3B:
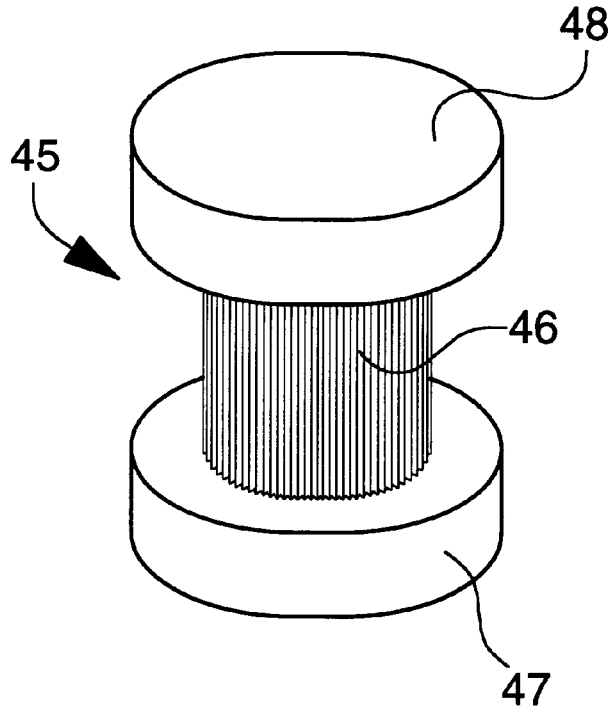

According to another embodiment, which is not shown, the opposite edges of rigid arm 28 and flexible arm 32 can each include only one notch, preferably with a grooved wall, between which a pin 45 is inserted, whose two heads 46, 48 are connected by a body 47, of oval cross-section and including grooves (see FIG. 3B) along its axis. This pin 45 will act as a cam and, according to the orientation which it is given between two opposite notches, will produce a mechanical bias on the flexible arm which will enable it to vary the reaction force. As indicated, FIG. 2 shows the new position occupied by the mechanism above support 2 when a force F is applied via push-button 4. Lever 11 performs a rotational movement about its pin 12 driving second member 20. Given that base 22 of this second element 20 includes guide means 23, forced to effect a rectilinear movement by guide ramp 3, rigid arm 28 will effect a rotation about pin 14 which will force the pin to come out of its notch 34 producing a clicking and to slide along outer edge 38 of tip 36. Depending on the initial inclination of edge 38 of tip 36, the force F which has to be exerted will be more or less significant. By effecting this movement, stud 25 which acts as guide means 23 will move mechanical control means 5 represented by a lever, and extension 26 of base 2 will close an electric contact 6. As can easily be imagined, according to the respective arrangement of members 5 and 6, these operations can be simultaneous or successive. When the push-button is released, the mechanism is returned to the initial position (FIG. 1) by the elastic return force of flexible arm 32.

Figure 4:
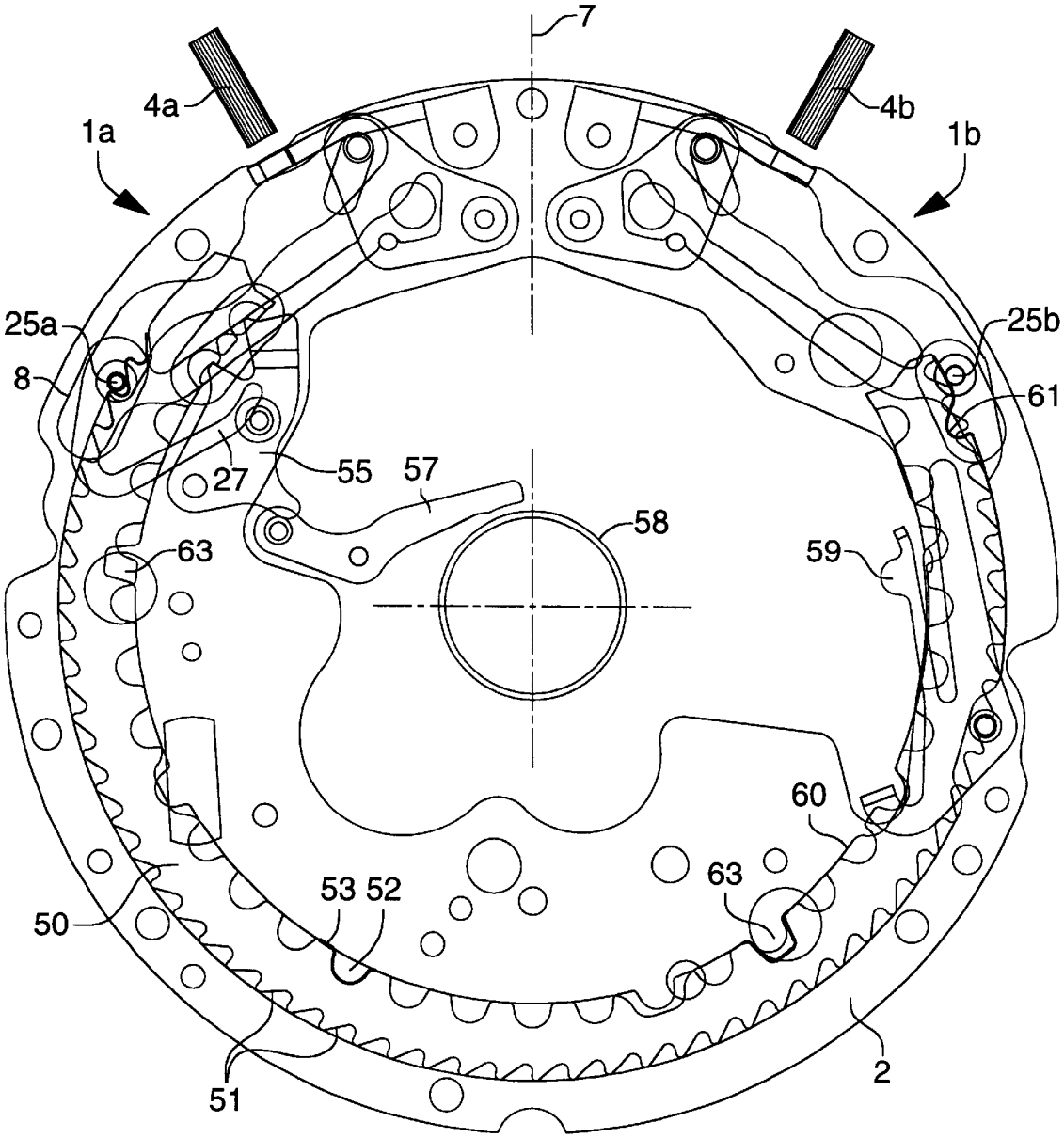
FIG. 4 is a top view of a portion of the kinematic chain of a chronograph watch in the off position including two mechanisms according to the invention.
Figure 5:
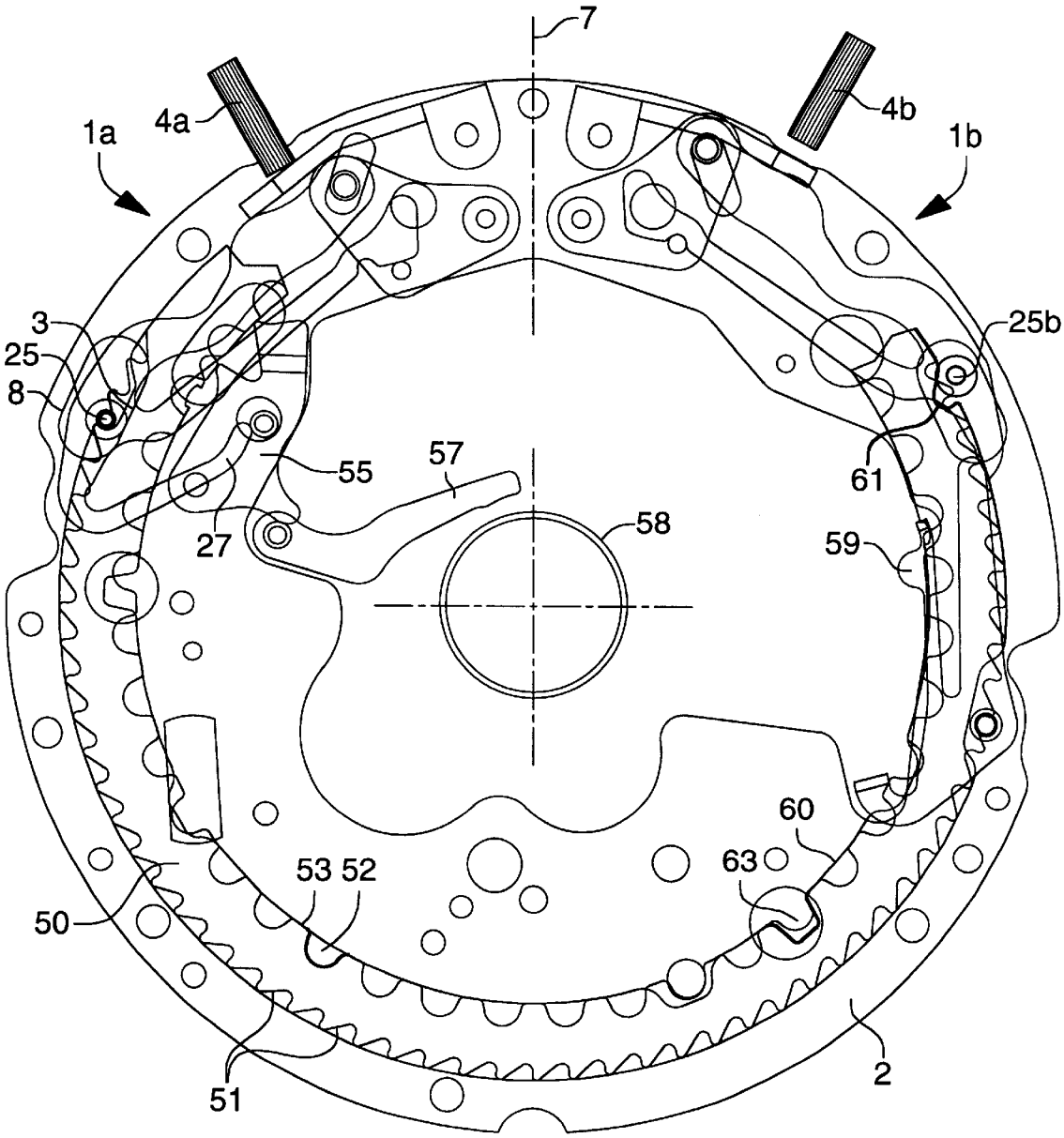

FIGS. 4 and 5 show, without the gear trains and all the associated controls, a chronograph watch including on either side of pin 7 of the winding stem, two mechanisms 1*a* and 1*b* according to the invention arranged back-to-back, and used, via push-buttons 4*a*, 4*b* to activate respectively the stop/start function and the reset to zero function of the chronograph.

The kinematic chain, given by way of example and on which these two mechanisms act, is of the same type as that described in detail in U.S. Pat. No. 5,113,382 including in particular two superposed annular control cams 50, 60, which are not shown for purposes of clarity in the portion including mechanisms 1*a*, 1*b*.

Mechanism la acts on the one hand on an annular cam 50 and on the other hand on a set of levers 55, 57. The outer portion of cam 50 is provided with teeth 51 allowing it to be driven in rotation by one step by means of stud 25 at each pressure on the push-button. The inner portion of cam 50 is provided with a regular succession of notches 52 and studs 53, each in a number equal to half the number of teeth 51. Starting from the inactive position (FIG. 4), FIG. 5 shows that by exerting a force on push-button 4*a* stud 25*a* moves into an oblong hole 8, acting as guide ramp 3, driving through one step cam 50, which will cause stopper member 59 to swing onto second cam 60 to prevent resetting to zero and releasing the wheel of chronograph 58 by means of extension 27 of the base acting via a lever 55 on brake 57 to raise it. Mechanism 1*a* thus allows two co-ordinated functions to be controlled as well as the cam.

Zero reset mechanism 1*b* corresponds to the same principle, but the corresponding cam 60 has on its outer portion a single driving notch 61 where stud 25 is engaged and means (not shown) for returning it to its initial position. The inner portion of the cam includes notches 63 which allow hammers, distributed around the periphery of the dial, to fall onto the reset heart-shaped cams of the counters, the heart-shaped cams and the hammers not being shown in the Figures.

What is claimed is:

1. A push-button mechanism for activating a mechanical or electric function including first and second members which are mobile in relation to each other in planes parallel to a plane support to form return means and to produce a clicking under the action of a force F exerted by means of the push-button, wherein the first member is formed by a lever which pivots via one of its ends on a stud attached to the plane support, said lever including two other pins arranged in a triangle with respect to the stud, and the second member of generally elongated shape includes a substantially U shaped cut-out portion delimiting a base connecting first and second arms, said base including guide means intended to slide along a guide ramp attached to the plate and at least one control means for a function to be activated, the first arm of said second member being rigid and having its free end rotatably mounted on a first pin of the lever and the second arm being flexible while having at its free end a notch against which the second pin of the lever rests in the inactive position, said notch being extended by a beak shaped tip having an external edge oriented towards the exterior of the U shaped cut-out portion, against which the second pin of the lever slides when a force F is exerted on the rigid arm via the push-button by compressing the flexible arm and producing a clicking by passing from one position to the other.

2. A mechanism according to claim 1, wherein the inclination of the external edge of the tip allows the force F which has to be applied to the rigid arm of the mechanism to be varied.

3. A mechanism according to claim 1, wherein it further includes means for adjusting the force F which has to be applied to the push-button, said adjusting means being arranged between parallel edges of the notch so as to modify the flexion point of the flexible arm or its initial distance with respect to the rigid arm.

4. A mechanism according to claim 3, wherein the adjusting means are formed by a pin with a cylindrical body able to occupy several positions between facing notches arranged in the parallel edges of the rigid arm and the flexible arm.

5. A mechanism according to claim 4, wherein the notches for positioning the pin are arranged and spaced in such a way that a variation of approximately 10% in the force F which has to be applied via the push-button is obtained from one position to the next.

6. A mechanism according to claim 3, wherein the adjusting means are formed by a pin with a grooved oval body arranged between two grooved opposite notches arranged in the edges of the rigid arm and the flexible arm to act as a cam.

7. A mechanism according to claim 4, wherein the pin is held in a determined position between the two opposite edges of the rigid arm and the flexible arm by welding.

8. A mechanism according to claim 1, wherein the guide means is formed by a stud driven into the base of the second member.

9. A mechanism according to claim 8, wherein the stud also constitutes a control means for an electric or mechanical function.

10. A mechanism according to claim 8, wherein a control means is formed by the base itself, or by an extension of the latter in the form of an arm.

11. A mechanism according to claim 1, wherein the guide ramp is formed by an oblong hole in the plate or in a member attached thereto to allow the travel of the mechanism to be limited between two extreme positions.

12. A mechanism according to claim 11, wherein a single pressure exerted on the push-button allows a toothed crown to advance by one step.

13. A mechanism according to claim 1, wherein the first and second members are cut in a plate, the lever having a substantially triangular shape and the cut out member having a wide rigid arm and a narrow flexible arm.

14. A mechanism according to claim 13, wherein the plate in which the two members are cut is made of metal or a metal alloy.

15. A chronograph watch including two mechanisms according to claim 1, said mechanisms being arranged back-to-back on either side of a winding stem and allowing respectively a start/stop function and a reset to zero function of the chronograph watch to be controlled.

16. The mechanism according to claim 6, wherein the pin is held in a determined position between the two opposite edges of the rigid arm and the flexible arm by welding.

17. The mechanism according to claim 9, wherein a control means is formed by the base itself, or by an extension of the latter in the form of an arm.

* * * * *